US010316271B2

(12) United States Patent
Merget et al.

(10) Patent No.: US 10,316,271 B2
(45) Date of Patent: Jun. 11, 2019

(54) CARBONATE ESTER ANTI-FOAMING AGENT AND USE THEREOF IN DETERGENTS

(71) Applicant: Wacker Chemie AG, Munich (DE)

(72) Inventors: Markus Merget, Mehring (DE); Richard Becker, Ann Arbor, MI (US)

(73) Assignee: WACKER CHEMIE AG, Munich (DE)

( * ) Notice: Subject to any disclaimer, the term of this patent is extended or adjusted under 35 U.S.C. 154(b) by 167 days.

(21) Appl. No.: 15/537,140

(22) PCT Filed: Apr. 26, 2016

(86) PCT No.: PCT/EP2016/059262
§ 371 (c)(1),
(2) Date: Jun. 16, 2017

(87) PCT Pub. No.: WO2016/174016
PCT Pub. Date: Nov. 3, 2016

(65) Prior Publication Data

US 2018/0265813 A1 Sep. 20, 2018

(30) Foreign Application Priority Data

Apr. 29, 2015 (DE) ..... 10 2015 207 890

(51) Int. Cl.
*C11D 3/37* (2006.01)
*C11D 3/00* (2006.01)

(52) U.S. Cl.
CPC ..... *C11D 3/3742* (2013.01); *C11D 3/0026* (2013.01)

(58) Field of Classification Search
CPC ..... C11D 3/10; C11D 3/162; C11D 3/373
See application file for complete search history.

(56) References Cited

U.S. PATENT DOCUMENTS

| | | | | |
|---|---|---|---|---|
| 4,637,890 | A | 1/1987 | Crabtree et al. | |
| 4,894,117 | A | 1/1990 | Bianchi et al. | |
| 4,894,177 | A * | 1/1990 | Starch | C11D 3/0026 23/313 R |
| 8,481,476 | B2 * | 7/2013 | Paul | B01D 19/0409 510/347 |
| 8,633,147 | B2 * | 1/2014 | Paul | B01D 19/0404 510/276 |
| 2010/0292353 | A1 | 11/2010 | Becker et al. | |
| 2012/0065118 | A1 * | 3/2012 | Paul | B01D 19/0404 510/347 |
| 2012/0329701 | A1 * | 12/2012 | Paul | B01D 19/0409 510/513 |
| 2013/0309498 | A1 | 11/2013 | Chao et al. | |
| 2015/0165345 | A1 | 6/2015 | Merget et al. | |

FOREIGN PATENT DOCUMENTS

| | | | |
|---|---|---|---|
| EP | 0 254 499 | B1 | 1/1988 |
| EP | 0 685 250 | A1 | 12/1995 |
| WO | 2011/107361 | A2 | 9/2011 |
| WO | 2011/107397 | A1 | 9/2011 |
| WO | 2013/189825 | A1 | 12/2013 |
| WO | 2013189825 | * | 12/2013 |

OTHER PUBLICATIONS

Walter Noll: Chemistry and Technology of Silicones, Academic Press Inc., 1968, p. 1-9.
Handbook of Detergents, Part D, Chapt. 3, p. 51 ff.: Randall A. Watson "Laundry Detergent Formulations".

* cited by examiner

*Primary Examiner* — Charles I Boyer
(74) *Attorney, Agent, or Firm* — Brooks Kushman P.C.

(57) ABSTRACT

Antifoam compositions for textile washing having a delayed antifoam effect contain an aminoalkyl-functional organopolysiloxanes wherein at least one aminoalkyl group is modified by reaction with an alkanol.

10 Claims, No Drawings

CARBONATE ESTER ANTI-FOAMING AGENT AND USE THEREOF IN DETERGENTS

CROSS REFERENCE TO RELATED APPLICATIONS

This application is the U.S. National Phase of PCT Appln. No. PCT/EP2016/059262 filed Apr. 26, 2016, which claims priority to German Application DE 10 2015 207 890.6, filed Apr. 29, 2015, the disclosures of which are incorporated in their entirety by reference herein.

BACKGROUND OF THE INVENTION

1. Field of the Invention

The invention relates to antifoam agents and to the use thereof in detergent compositions.

2. Description of the Related Art

Hand washing involves placing water into a bucket or soaking container, and machine-assisted hand washing involves placing water into the washing drum of a washing machine. Then, the desired amount of detergent is dosed. As a result of stirring by hand or leaving the washing machine to run, foam is generated. In the next step, the soiled laundry is immersed and left to soak for 10 to 30 min. In the case of hand washing, after this time the laundry is washed by hand to remove soiling. In the case of washing machines, the wash cycle is started (duration: approx. 60 minutes). Significant foam formation during the wash cycle is interpreted as a good cleaning effect of the detergent.

During rinsing, the excess wash liquor is poured away and the textiles are wrung out to remove the excess absorbed wash liquor. The rinse cycles consist of addition of fresh water, rinsing of the textiles to remove detergent residues, pouring away of the rinse liquor and wringing out of the textiles to remove the absorbed rinse liquor. As a rule, these rinse cycles are repeated until foam is no longer visible (4 to 5 times). The formation of foam during the rinse cycle is correlated with the presence of detergent, which is undesired.

In order to reduce water consumption and to protect the environment, it would therefore be desirable to have an antifoam agent which only barely influences foaming in the wash cycle, if at all, and suppresses, with lasting effect, the formation of new foam in the rinse cycle. As a result, the number of rinse cycles and therefore the amount of consumed water could be reduced.

U.S. Pat. No. 4,637,890 describes a granular detergent composition which brings about reduced foaming and reduced turbidity of rinse water during the rinse cycle which follows a wash cycle, where the composition comprises a surfactant, a water-soluble detergent builder and foam regulating granules which comprise a silicone oil as foam suppressant, and additionally fatty acid soap and a quaternary ammonium salt.

The antifoam agent in this case only becomes active at a low pH; in the wash cycle at pH values of >9 it is inactive. In the case of hand washing or in the case of machine-assisted hand washing and in the case of machine washing, these high pH values are usually not reached in non-industrial application, meaning that the defoaming effect starts prematurely in the wash cycle.

U.S. Pat. No. 4,894,117 describes a composition of an agglomerated granulate for the delayed release of an antifoam agent in a wash liquor. These antifoam granules exhibit a delayed release as a result of the fact that the silicone antifoam agent is encapsulated with cellulose.

EP 254 499 B1 discloses a silicone antifoam composition which is obtained by reacting a mixture of a trimethylsilyl-terminated polydimethylsiloxane and a silanol-terminated polydimethylsiloxane with a polyoxyethylene-polyoxypropylene copolymer and with silica. Use as an antifoam agent in detergent compositions is not described.

The two aforementioned documents utilize the technology of encapsulating silicones or silicone antifoams, where these substance classes have a strong antifoam effect. The activity of the delayed antifoam effect in the rinse cycle is dependent on the release of these active ingredients, which in turn depends on many parameters such as, for example, the temperature of the liquor and the duration of the individual steps. Consequently, the use of these systems is possible exclusively for machine washing, where reproducible conditions exist with regard to temperature and duration. In the case of hand washing or in the case of machine-assisted hand washing, these systems cannot be used on account of different washing practices. On the other hand, a product which has delayed antifoam action or foam suppression irrespective of external parameters in the rinse cycle in the case of hand washing or in the case of machine-assisted hand washing is also effective in the case of machine washing.

WO 2011/107361 A2 and WO 2011/107397 A1 describe, as antifoam agents, a polyether-containing aminosiloxane or a powder which comprises a polyether-containing aminosiloxane on a carrier substance, and also the production process as well as the use of this antifoam agent in detergent compositions for hand washing and machine washing, where the antifoam agent only develops its antifoam effect during the rinse cycle. The aminosiloxane on which the antifoam agent is based contains a terminal polyether fragment.

The active ingredients used are thus polyether-containing aminosiloxanes which only develop a delayed antifoam effect or foam suppression in the rinse cycle and which are costly to produce. Such materials are produced in practice by equilibration reactions starting from OH-terminated polydimethylsiloxanes, $\alpha,\omega$-polyether-functional siloxanes and hydrolysates of the corresponding aminoalkylsilanes. A disadvantage of this is that during their synthesis two-phase reaction mixtures are often obtained since the polyethersiloxane is incompatible with the rest of the components because of different polarities.

EP 685 250 A1 discloses the use of a mixture of an aminosiloxane and a highly disperse silica in detergents for preventing foaming during the rinse cycle.

A disadvantage of these mixtures is that the antifoam effect starts prematurely in the wash cycle and is not delayed until the rinse cycle. In the case of hand washing or in the case of machine-assisted hand washing, considerable foaming is desirable during the wash cycle and is interpreted as a sign of good cleaning effect of the detergent and therefore of cleanliness.

WO 2013/189825 A1 describes an amine oil on a carrier substance as an antifoam agent. A disadvantage is the reduced storage stability, i.e. the antifoam effect decreases following storage of the antifoam agent.

SUMMARY OF THE INVENTION

It was an object of the invention to provide an antifoam agent in bulk or as powder on a carrier material, which can preferably be used in detergent formulations for textiles, where the foaming behaviour of the detergent is not influenced by the wash cycle, and a good antifoam effect arises only at a later time during the rinse cycles, and where the antifoam effect is not significantly reduced even after storage of the antifoam agent or of the powder. These and other objects are met through providing an antifoam composition containing 5-35 wt. % of a modified aminofunctional organopolysiloxane, and 65-95% of a carrier material.

DETAILED DESCRIPTION OF THE PREFERRED EMBODIMENTS

The invention thus provides antifoam powders with delayed antifoam effect, comprising (1) 5 to 35% by weight of an antifoam agent, which is a modified, aminofunctional organopolysiloxane consisting of at least one siloxane unit of the formula $$R^1_a Q_b SiO_{\frac{4-(a+b)}{2}} \quad \text{(I)}$$

and siloxane units of the formula $$R^1_c SiO_{\frac{4-c}{2}}, \quad \text{(II)}$$

where $R^1$ is identical or different and is a hydrogen atom, a monovalent, optionally fluorine-, chlorine- or bromine-atom-substituted $C_1$- to $C_{18}$-hydrocarbon radical or a $C_1$- to $C_{12}$-alkoxy radical or a hydroxy radical, preferably a $C_1$- to $C_{18}$-hydrocarbon radical or a $C_1$- to $C_3$-alkoxy radical or a hydroxy radical, Q is identical or different and is a modified or unmodified amino radical of the formula $$—R^2—[NR^3—(CH_2)_m—]_x NR^4R^5 \quad \text{(III)}$$

or forms thereof partially or completely protonated on the nitrogen atoms, where $R^2$ is a divalent $C_1$-$C_{18}$-hydrocarbon radical, preferably a divalent $C_2$- to $C_4$-hydrocarbon radical, $R^3$ is a hydrogen atom, a $C_1$-$C_{10}$-alkyl radical or a radical G of the formula $$—C(=O)—O—R^6 \quad \text{(IV)},$$

$R^4$ is a hydrogen atom, a $C_1$-$C_{10}$-alkyl radical or a radical G of the formula (IV), $R^5$ is a hydrogen atom, a $C_1$-$C_{10}$-alkyl radical or a radical G of the formula (IV), $R^6$ is a monovalent hydrocarbon radical having 1 to 18 carbon atoms which is unsubstituted or is substituted with one or two hydroxy groups, preferably with one hydroxy group, with the proviso that at least one radical Q has at least one radical G of the formula (IV), a is 0, 1 or 2, preferably 0 or 1, b is 1, 2 or 3, preferably 1, c is 0, 1, 2 or 3, preferably 2 or 3, m is 2, 3 or 4, preferably 2 or 3, and x is 0, 1 or 2, preferably 0 or 1, and the sum a+b is less than or equal to 3, and (2) 65 to 95% by weight of a carrier material selected from the group of sodium carbonate, sodium sulfate, aluminium silicate, potassium carbonate, potassium sulfate, sodium hydrogen carbonate, potassium hydrogen carbonate, zeolites, porous copolymers of urea or melamine or mixtures thereof with an alkanal, and mixtures thereof.

Preferably, the antifoam powder according to the invention consists of (1) aminosiloxane and the aforementioned (2) carrier material.

Preferably, therefore, the co-use of silicas in the antifoam powders according to the invention is excluded.

The organopolysiloxanes according to the invention preferably contain preferably both amino radicals Q which have at least one radical G of the formula (IV), i.e. are modified, as well as amino radicals Q which have no radical G of the formula (IV), i.e. are unmodified. At least one modified amino radical Q is present in the organopolysiloxane (1).

Examples of $C_1$- to $C_{18}$-hydrocarbon radicals $R^1$ are alkyl radicals such as the methyl, ethyl, n-propyl, isopropyl, n-butyl, isobutyl, tert-butyl, n-pentyl, isopentyl, neopentyl, and tert-pentyl radicals; hexyl radicals such as the n-hexyl radical; heptyl radicals such as the n-heptyl radical; octyl radicals such as the n-octyl radical and isooctyl radicals such as the 2,2,4-trimethylpentyl radical; nonyl radicals such as the n-nonyl radical; decyl radicals, such as the n-decyl radical; dodecyl radicals such as the n-dodecyl radical; cycloalkyl radicals such as cyclopentyl, cyclohexyl, cycloheptyl and methylcyclohexyl radicals; aryl radicals such as the phenyl and the naphthyl radicals; alkaryl radicals such as the o-, m-, and p-tolyl radicals, xylyl radicals and ethylphenyl radicals; and aralkyl radicals such as the benzyl radical and the alpha- and the beta-phenylethyl radicals.

Examples of fluorine-, chlorine- or bromine-atom-substituted radicals $R^1$ are haloalkyl radicals, such as the 3,3,3-trifluoro-n-propyl radical, the 2,2,2,2',2',2'-hexafluoroisopropyl radical, the heptafluoroisopropyl radical and the o-, m- and p-chlorophenyl radicals.

The alkoxy radicals $R^1$ are alkyl radicals described above bonded via an oxygen atom, with examples of these alkyl radicals also applying in their entirety to the alkoxy radicals.

Examples of the divalent $C_1$- to $C_{18}$-hydrocarbon radicals $R^2$ are saturated straight- or branch-chain or cyclic alkylene radicals, such as the methylene and ethylene radicals, and also the propylene, butylene, pentylene, hexylene, 2-methylpropylene, cyclohexylene and octadecylene radicals, or unsaturated alkylene or arylene radicals such as the hexenylene radical and phenylene radical, with the n-propylene radical and the 2-methylpropylene radical being particularly preferred.

Examples of $C_1$- to $C_{10}$-alkyl radicals $R^3$, $R^4$ and $R^5$ are the examples listed above for $R^1$ of linear and cyclic alkyl radicals and of fluorine-, chlorine- or bromine-atom-substituted $C_1$- to $C_{10}$-alkyl radicals.

Examples of $C_1$ to $C_{18}$-hydrocarbon radicals $R^6$ are the hydrocarbon radicals listed above for $R^1$, where the hydrocarbon radicals are unsubstituted or are substituted with one or two hydroxy groups, preferably with one hydroxy group.

Preferred examples of $R^6$ are radicals of the formula $$—CH_2—CH_2OH,$$

$$—CH(CH_3)CH_2OH,$$

$$—CH_2CH(CH_3)OH,$$

$$—CH_2CH(CH_2OH)_2 \text{ and}$$

$$—CH(CH_2OH)CH_2(CH_2OH),$$

where the radical of the formula $—CH_2CH(CH_3)OH$ (VI) is a particularly preferred radical $R^6$.

Preferred examples of radicals G are therefore radicals of the formula $—C(=O)—O—CH_2—CH_2—OH$, $—C(=O)—O—CH(CH_3)CH_2OH$, $—C(=O)—O—CH_2CH(CH_3)OH$, $—C(=O)—O—CH_2CH(CH_2OH)_2$ and $—C(=O)—O—CH(CH_2OH)CH_2(CH_2OH)$, where $—C(=O)—O—CH_2CH(CH_3)OH$ is particularly preferred.

Examples of unmodified amino radicals Q are those of the formula $NH_2CH_2CH_2NH(CH_2)_3—$, $NH_2(CH_2)_3—$, $CH_3NHCH_2CH_2NH(CH_2)_3—$, $(CH_3)_2NCH_2CH_2NH(CH_2)_3—$, $(CH_3)_2NCH_2CH_2CH_2NH(CH_2)_3—$, $CH_3CH_2HN(CH_2)_2NH(CH_2)_3—$, $(CH_3CH_2)_2N(CH_2)_2NH(CH_2)_3—$, $CH_3CH_2CH_2HN(CH_2)_2NH(CH_2)_3—$, $(CH_3CH_2CH_2)_2N(CH_2)_2NH(CH_2)_3—$ and (cyclohexyl)$HN(CH_2)_2NHCH_2CH(CH_3)CH_2—$, where $NH_2CH_2CH_2NH(CH_2)_3—$ is a preferred example, or forms thereof partially or completely protonated on the nitrogen atoms.

Examples of modified amino radicals are radicals of the formula (G-)$NHCH_2CH_2NH(CH_2)_3—$, $NH_2CH_2CH_2$(G-)$N(CH_2)_3—$, (G-)$NHCH_2CH_2$(G-)$N(CH_2)_3—$, (G-)$_2NCH_2CH_2NH(CH_2)_3—$ and (G-)$_2NCH_2CH_2$(G-)$N(CH_2)_3—$, where G is a radical of the formula (IV), preferably G are radicals of the formulae $—C(=O)—O—CH_2—CH_2—OH$, $—C(=O)—O—CH(CH_3)CH_2OH$, $—C(=O)—O—CH_2CH(CH_3)OH$, $—C(=O)—O—CH_2CH(CH_2OH)_2$ and $—C(=O)—O—CH(CH_2OH)CH_2(CH_2OH)$, and preferably G is a radical of the formula $—C(=O)—O—CH_2CH(CH_3)OH$.

Examples of preferred modified amino radicals Q are those of the formula $HO(CH_2)_2OC(=O)NH(CH_2)_2NH(CH_2)_3—$ $HOCH_2CH(CH_3)OC(=O)NH(CH_2)_2NH(CH_2)_3—$ $HOCH(CH_3)CH_2OC(=O)NH(CH_2)_2NH(CH_2)_3—$ $HOCH_2CH(CH_2OH)OC(=O)NH(CH_2)_2NH(CH_2)_3—$ $HOCH(CH_2OH)CH_2OC(=O)NH(CH_2)_2NH(CH_2)_3—$ $H_2N(CH_2)_2N[C(=O)O(CH_2)_2OH](CH_2)_3—$ $H_2N(CH_2)_2N[C(=O)OCH_2CH(CH_3)OH](CH_2)_3—$ $H_2N(CH_2)_2N[C(=O)OCH(CH_3)CH_2OH](CH_2)_3—$ $H_2N(CH_2)_2N[C(=O)OCH_2CH(CH_2OH)OH](CH_2)_3—$ $H_2N(CH_2)_2N[C(=O)OCH(CH_2OH)CH_2OH](CH_2)_3—$ $[HO(CH_2)OC(=O)]_2N(CH_2)_2NH(CH_2)_3—$ $[HOCH_2CH(CH_3)OC(=O)]_2N(CH_2)_2NH(CH_2)_3—$ $[HOCH(CH_3)CH_2OC(=O)]_2N(CH_2)_2NH(CH_2)_3—$ $[HOCH_2CH(CH_2OH)OC(=O)]_2N(CH_2)_2NH(CH_2)_3—$ $[HOCH(CH_2OH)CH_2OC(=O)]_2N(CH_2)_2NH(CH_2)_3—$ $[HO(CH_2)OC(=O)]_2N(CH_2)_2N[C(=O)O(CH_2)_2OH](CH_2)_3—$ $[HOCH_2CH(CH_3)OC(=O)]_2N(CH_2)_2N[C(=O)OCH(CH_3)CH_2OH](CH_2)_3—$ $[HOCH(CH_3)CH_2OC(=O)]_2N(CH_2)_2N[C(=O)OCH_2CH(CH_3)OH](CH_2)_3—$ $[HOCH_2CH(CH_2OH)OC(=O)]_2N(CH_2)_2N[C(=O)OCH(CH_2OH)CH_2OH](CH_2)_3—$ and $[HOCH(CH_2OH)CH_2OC(=O)]_2N(CH_2)_2N[C(=O)OCH_2CH(CH_2OH)OH](CH_2)_3—$.

Particularly preferred antifoam agents are modified, aminofunctional organopolysiloxanes of the formula $$Q_kR^1_{3-k}SiO(R_2SiO)_p(QR^1SiO)_nSiR^1_{3-k}Q_k \quad (V),$$

where

R is identical or different and is a monovalent $C_1$- to $C_{18}$-hydrocarbon radical, $R^1$ has the meaning given for it above, Q has the meaning given for it above, k is 0 or 1, p is 0 or an integer from 1 to 1000, n is 0 or an integer from 1 to 50, with the proviso that the organopolysiloxanes contain at least one radical Q, which has at least one radical G of the formula (IV), per molecule.

Examples of $C_1$- to $C_{18}$-hydrocarbon radicals R are alkyl radicals such as the methyl, ethyl, n-propyl, isopropyl, n-butyl, isobutyl, tert-butyl, n-pentyl, isopentyl, neopentyl, and tert-pentyl radicals; hexyl radicals such as the n-hexyl radical; heptyl radicals such as the n-heptyl radical; octyl radicals such as the n-octyl radical and isooctyl radicals such as the 2,2,4-trimethylpentyl radical; nonyl radicals such as the n-nonyl radical, decyl radicals, such as the n-decyl radical; dodecyl radicals such as the n-dodecyl radical; cycloalkyl radicals such as cyclopentyl, cyclohexyl, cycloheptyl and methylcyclohexyl radicals; aryl radicals such as the phenyl and the naphthyl radicals; alkaryl radicals, such as the o-, m-, and p-tolyl radicals, xylyl radicals and ethylphenyl radicals; and aralkyl radicals such as the benzyl radical and the alpha- and the beta-phenylethyl radicals.

The organopolysiloxanes of the formula (V) preferably preferably both amino radicals Q, which have at least one radical G of the formula (IV), i.e. are modified, as well as amino radicals Q, which have no radical G of the formula (IV), i.e. are unmodified. The organopolysiloxanes of the formula (V) therefore comprise at least one modified amino radical Q.

Examples of modified, aminofunctional organopolysiloxanes of the formula (V) are aminofunctional polydimethylsiloxanes terminated with trimethylsiloxane units and aminofunctional polydimethylsiloxanes terminated with hydroxydimethylsiloxane units and $C_1$-$C_3$-alkoxydimethylsiloxane units.

Preferably, the ratio of the siloxane units of the general formula (I) to the siloxane units of the general formula (II) is 1:1 to 1:10 000, preferably 1:2 to 1:300. The amine contents are preferably 0.05 to 6 mequiv/g, preferably 0.1 to 5 mequiv/g, measured as consumption of 1N hydrochloric acid in ml/g aminofunctional organopolysiloxane during titration to the neutral point.

The modified, aminofunctional organopolysiloxanes preferably have an average viscosity of from 25 to 100,000 mPa·s, preferably 50 to 50,000 mPa·s, at 25° C.

The modified, aminofunctional organopolysiloxanes can be used diluted in organic solvents. Examples of organic solvents are alcohols, such as methanol, ethanol, isopropanol and butanol.

Aminofunctional organopolysiloxanes are known and their preparation is described, for example, in WO 2013/189825 A1. The modified, aminofunctional organopolysiloxanes (1) according to the invention are preferably prepared by reacting aminofunctional organopolysiloxanes with acyclic or cyclic carbonates.

Examples of cyclic carbonates are 4-methyl-1,3-dioxolan-2-one and 1,3-dioxolan-2-one and 4-(hydroxymethyl)-1,3-dioxolan-2-one. An example of an acyclic carbonate is diethyl carbonate. The acyclic and cyclic carbonates are preferably used in amounts of from 0.01 to 1.45 mol of carbonate per mole of unmodified, primary and secondary amino radical in the aminofunctional organopolysiloxane. The reaction preferably takes place at temperatures of from 20 to 160° C. and preferably at the pressure of the ambient atmosphere.

As an antifoam agent, it is possible to use one type of aminofunctional organopolysiloxane (1) or different types of aminofunctional organopolysiloxanes (1).

The amino radicals Q in formula (I) and formula (V) can be partially or completely protonated.

The amino radical Q of the formula (III) can be partially or completely protonated by adding acids to the aminofunctional organopolysiloxanes, giving the salt forms of the amino radicals.

Examples of acids are carboxylic acids having 3 to 18 carbon atoms, which may be linear or branched, such as formic acid, acetic acid, propionic acid, butanoic acid, pivalic acid, sorbic acid, benzoic acid and salicylic acid.

Preferably, the organopolysiloxanes (1) according to the invention can comprise protonated amino radicals Q' of the formula $$—R^2—[NR^3—(CH_2)_m—]_xNH^+R^4R^5\ Z^- \quad \text{(Va) or}$$

$$—R^2—[NH^+R^3—(CH_2)_m—]_xNH^+R^4R^5\ (x+1)Z^- \quad \text{(Vb),}$$

where $Z^-$ is an anion to $N^+$, preferably an anion of a corresponding acid, preferably an anion of a carboxylic acid, such as an acetate anion, and $R^2$, $R^3$, $R^4$, $R^5$, m and x have the meanings given for them above.

A preferred example of an unmodified amino radical Q is the radical $NH_2CH_2CH_2NH(CH_2)_3$— and the radicals $N^+H_3CH_2CH_2NH(CH_2)_3$— $Z^-$ or $N^+H_3CH_2CH_2N^+H_2(CH_2)_3$— 2 $Z^-$ (where $Z^-$ has the meaning given for it above)

are therefore preferred protonated amino radicals Q'.

Examples of preferred modified amino radicals are radicals of the formulae $$(G\text{-})NHCH_2CH_2NH(CH_2)_3—,$$

$$NH_2CH_2CH_2(G\text{-})N(CH_2)_3—,$$

$$(G\text{-})NHCH_2CH_2(G\text{-})N(CH_2)_3—,$$

$$(G\text{-})_2NCH_2CH_2NH(CH_2)_3— \text{ and } (G\text{-})_2NCH_2CH_2(G\text{-})N(CH_2)_3—,$$

where the modified radicals can be partially or completely protonated on the nitrogen atoms, where G is a radical of the formula (IV), preferably a radical of the formula —C(=O)—O—$CH_2CH(CH_3)OH$ (VI).

The antifoam powders according to the invention are preferably produced by mixing the modified, aminofunctional organopolysiloxanes (1) with the carrier materials (2).

Preferably, the carrier material (2) is initially introduced and then the aminosiloxane (1) is added thereto and mixed with (2). The mixing can take place at temperatures of from 20 to 120° C. and at the pressure of the ambient atmosphere, i.e. at about 1020 hPa, or else at higher or lower pressures.

The carrier material used may be a porous copolymer of urea or melamine or mixtures thereof with an alkanal, with the use thereof not being preferred.

This porous copolymer and its preparation are described in US 2010/0292353 A1, paragraphs [0009] to [0020] (incorporated by reference).

The antifoam agents according to the invention or powders thereof have the advantage that they do not influence the foaming behaviour of the detergent in the wash cycle and a good antifoam effect does not arise until during the rinse cycles in a delayed manner.

Compared to unmodified amine oils, the modified amine oils according to the invention have better storage stability. The antifoam agents according to the invention or powders thereof therefore have the advantage that the antifoam effect is only slightly reduced, if at all, even after storage.

The antifoam agents according to the invention or powders thereof additionally have the advantage of saving large amounts of water by avoiding unnecessary rinse cycles, and can be used for different areas of application such as, for example, personal care, hair care, home care and the like.

The invention therefore provides detergent compositions comprising (A) antifoam agents according to the invention or powders thereof and (B) customary detergent components.

The antifoam agents according to the invention or powders thereof are preferably used in the detergent compositions in amounts of 0.5 to 5% by weight, based on the detergent composition.

Preferably, the detergent compositions are used for hand washing or machine-assisted hand washing. However, they can also be used for machine washing.

Examples of customary detergent components (B) for hand washing or machine washing are surfactants, preferably anionic and nonionic surfactants, builders, bleaches, enzymes, chelating compounds and perfumes, as described, for example, in Handbook of Detergents, Part D, Chapt. 3, p. 51 ff.: Randall A. Watson "Laundry Detergent Formulations".

EXAMPLES

In the examples described below, all of the viscosity data refer to a temperature of 25° C.

The viscosities for the organopolysiloxanes are determined using the Brookfield viscometer in accordance with DIN EN ISO 2555.

1. Synthesis of the Modified Amine Oils According to the Invention

Example 1

2.14 g of 4-methyl-1,3-dioxolan-2-one and 80.0 g of a pendently functionalized, trimethylsilyl-terminated aminoethyl-aminopropyl-polydimethylsiloxane with an amine number of 2.08 mmol/g and a viscosity of 210 mPas are initially charged in a flask (two-phase mixture), heated to 60° C. and stirred at this temperature for 2 h. A clear solution of the modified amine oil (amine oil 1) is obtained from the initially cloudy reaction mixture.

The primary amino groups of the siloxane raw material are converted to approx. 25%. In the $^1$H-NMR, the formation of the signal of the $CH_2$—NHC(O) group between 3.1 and 3.4 ppm to 24.6% (based on the sum of all signals of the Si—$CH_2$ group between 0.3 and 0.6 ppm) is discernible.

Example 2

4.26 g of 4-methyl-1,3-dioxolan-2-one and 80.0 g of a pendently functionalized, trimethylsilyl-terminated aminoethyl-aminopropyl-polydimethylsiloxane with an amine number of 2.07 mmol/g and a viscosity of 3020 mPas (starting material 2) are initially introduced in a flask (two-phase mixture), heated to 60° C. and stirred at this temperature for 2 h. A clear solution of the modified amine oil (amine oil 2) is obtained from the initially cloudy reaction mixture.

The primary amino groups of the siloxane raw material are converted to approx. 50%. In the $^1$H-NMR, the formation of the signal of the $CH_2$—NHC(O) group between 3.1 and 3.4 ppm to 49.7% (based on the sum of all signals of the Si—$CH_2$ group between 0.3 and 0.6 ppm) is discernible.

Example 3

5.75 g of 4-methyl-1,3-dioxolan-2-one and 70.0 g of a pendently functionalized, trimethylsilyl-terminated aminoethyl-aminopropyl-polydimethylsiloxane (diluted with 18.9 g of isopropanol) with an amine number of 2.13 mmol/g (starting material 3) and a viscosity of 6330 mPas are initially introduced in a flask (two-phase mixture), heated to 60° C. and stirred at this temperature for 2 h. A clear solution of the modified amine oil in isopropanol (80% strength) (amine oil 3) is obtained from the initially cloudy reaction mixture.

The primary amino groups of the siloxane raw material are converted to approx. 50%. In the $^1$H-NMR, the formation of the signal of the $CH_2$—NHC(O) group between 3.1 and 3.4 ppm to 73.5% (based on the sum of all signals of the Si—$CH_2$ group between 0.3 and 0.6 ppm) is discernible.

Example 4

10.7 g of 4-methyl-1,3-dioxolan-2-one and 100.0 g of a pendently functionalized, trimethylsilyl-terminated aminopropyl-polydimethylsiloxane with an amine number of 2.09 mmol/g and a viscosity of 779 mPas are initially introduced in a flask (two-phase mixture), heated to 60° C. and stirred at this temperature for 2 h. A clear solution of the modified amine oil (amine oil 4) is obtained from the initially cloudy reaction mixture.

The primary amino groups of the siloxane raw material are converted to approx. 50%. In the $^1$H-NMR, the formation of the signal of the $CH_2$—NHC(O) group between 3.0 and 3.3 ppm to 49.6% (based on the sum of all signals of the Si—$CH_2$ group between 0.3 and 0.6 ppm) is discernible.

Example 5

6.14 g of 4-(hydroxymethyl)-1,3-dioxolan-2-one and 100.0 g of a pendently functionalized, trimethylsilyl-terminated aminopropyl-polydimethylsiloxane with an amine number of 2.09 mmol/g and a viscosity of 779 mPas are initially introduced in a flask (two-phase mixture), heated to 60° C. and stirred at this temperature for 2 h. A clear solution of the modified amine oil (amine oil 5) is obtained from the initially cloudy reaction mixture.

The primary amino groups of the siloxane raw material are converted to approx. 25%. In the $^1$H-NMR, the formation of the signal of the $CH_2$—NHC(O) group between 3.0 and 3.3 ppm to 26.1% (based on the sum of all signals of the Si—$CH_2$ group between 0.3 and 0.6 ppm) is discernible.

2. Production of the Antifoam Powders According to the Invention and of the Antifoam Powders not According to the Invention A beaker is initially charged with 90 g of sodium carbonate powder (manufacturer: Sigma-Aldrich, article number 330361, particle size: <100 μm: 3.25%, 100-200 μm: 26.00%, 200-315 μm: 46.29%, 315-500 μm: 23.74%, 500-1000 μm: 0.67%, 1000-2000 μm: 0.05%, >2000 μm: 0%) and stirred with a paddle stirrer at 750 rpm. Subsequently, within 2 min, a pipette is used to uniformly add in each case 10 g of the above-described modified amine oils 1 to 5 (according to examples 1 to 5) or the unmodified amine oil starting materials 2 and 3 (not according to the invention) from examples 2 and 3 to the sodium carbonate powder. Following complete metered addition, the mixture is stirred for a further 1 min.

3. Application Tests for Hand Washing

The hand washing tests were carried out analogously to the following protocol:

- A bowl is initially charged with 5.0 l of completely demineralized water for the wash cycle.
- 17.5 g of Tide powder detergent, Prod. No. 99353576 (manufacturer Procter & Gamble, China) are mixed in a beaker with 1.05 g of antifoam powder (as prepared above in point 2) and added to the bowl.
- The resulting liquor is agitated gently for 2 min, such that the detergent formulation dissolves.
- A prewashed and dry terry cloth towel (100% cotton, size approx. 45×90 cm; weight per area approx. 500 g/m$^2$) is cut into four parts and weighed.

In each case a piece of terry cloth is dipped in the liquor and wrung out ten times.

30 seconds after the last dipping or wringing out, the wash liquor is photographed from above and the foam-covered surface area in percent is estimated.

All four terry cloth pieces are wrung out to a weight increase of 390 g (+/−0.5 g).

For the rinse cycle, a further bowl is initially charged with 5.0 l of completely demineralized water.

All four terry cloth pieces are placed into the bowl and in each case dipped three times and wrung out.

All four terry cloth pieces are brought to a weight increase of 450 g.

After 30 seconds, a photo is taken of the rinse liquor and the foam-covered surface area in percent is estimated.

In total, five rinse cycles, each with fresh water, are performed.

The results are summarized in Table 1.

TABLE 1

Foam in the wash cycle and in the rinse cycles in the case of hand washing

| Antifoam powder examples/ comparative example | Foam wash cycle [%] | Foam rinse cycle 1 [%] | Foam rinse cycle 2 [%] | Foam rinse cycle 3 [%] | Foam rinse cycle 4 [%] | Foam rinse cycle 5 [%] |
|---|---|---|---|---|---|---|
| Blank value | 100 | 100 | 90 | 40 | 10 | 10 |
| Example 1 | 100 | 95 | 0 | 0 | 0 | 0 |
| Example 2 | 100 | 100 | 0 | 0 | 0 | 0 |
| Example 3 | 100 | 100 | 0 | 0 | 0 | 0 |
| Example 4 | 100 | 5 | 0 | 0 | 0 | 0 |
| Example 5 | 100 | 30 | 0 | 0 | 0 | 0 |

In the examples given in Table 1, antifoam powders were produced according to the procedure described in point 2 using the amine oils described in examples 1 to 5. The concentration of the amine oil on the sodium carbonate carrier material was 10% in all cases.

The examples according to the invention exhibit a good antifoam effect in the rinse cycle, with the foaming in the wash cycle being barely influenced.

4. Tests Relating to the Storage Stability of the Produced Antifoam Powders

For the storage stability tests, the modified amine oils from examples 2 and 3 were compared with the corresponding starting materials 2 and 3. The starting materials 2 and 3 are the corresponding, unmodified amine oils and serve as comparative examples.

The reaction products of examples 2 and 3 as well as the starting materials 2 and 3 are converted to the corresponding antifoam powders analogously to "2. Production of the antifoam powders according to the invention and of the antifoam powders not according to the invention".

In each case 5 g of these antifoam powders are mixed in a beaker with 45 g of Tide power detergent, Prod. No. 99353576 (manufacturer Procter & Gamble, China). The resulting powders are sealed into a plastic film and stored at 40° C. and at an atmospheric humidity of 80%. After each sample is taken, the plastic film is sealed closed again.

The hand washing tests are carried out analogously to "3. Application tests for hand washing", except that the mixtures prepared above are used directly.

The results are summarized in Table 2.

TABLE 2

Foam in the wash cycle and the rinse cycles in the case of hand washing after various storage times [weeks]

| Antifoam powder examples/ comp. starting materials | Foam wash cycle [%] | Foam rinse cycle 1 [%] | Foam rinse cycle 2 [%] | Foam rinse cycle 3 [%] | Foam rinse cycle 4 [%] | Foam rinse cycle 5 [%] |
|---|---|---|---|---|---|---|
| Example 2 (t = 0 weeks) | 100 | 100 | 0 | 0 | 0 | 0 |
| Example 2 (t = 4 weeks) | 100 | 100 | 0 | 0 | 0 | 0 |
| Example 2 (t = 8 weeks) | 100 | 100 | 0 | 0 | 0 | 0 |
| Example 2 (t = 12 weeks) | 100 | 100 | 20 | 5 | 0 | 0 |
| Example 3 (t = 0 weeks) | 100 | 100 | 0 | 0 | 0 | 0 |
| Example 3 (t = 4 weeks) | 100 | 100 | 0 | 0 | 0 | 0 |
| Example 3 (t = 8 weeks) | 100 | 100 | 25 | 10 | 0 | 0 |
| Example 3 (t = 12 weeks) | 100 | 100 | 40 | 15 | 5 | 0 |
| Comp. starting material 2 (t = 0 weeks) | 100 | 100 | 10 | 5 | 0 | 0 |
| Comp. starting material 2 (t = 4 weeks) | 100 | 100 | 60 | 30 | 10 | 0 |
| Comp. starting material 3 (t = 0 weeks) | 100 | 100 | 5 | 5 | 0 | 0 |
| Comp. starting material 3 (t = 4 weeks) | 100 | 100 | 70 | 35 | 20 | 5 |

Even after prolonged storage, examples 2 and 3 (antifoam powders according to the invention with the modified amine oils) exhibit a good antifoam effect in the rinse cycle, whereas the starting materials 2 and 3 (antifoam powders not according to the invention with the unmodified amine oils) have already lost their effect after 4 weeks.

The invention claimed is:

1. An antifoam powder with a delayed antifoam effect, comprising (a) 5 to 35% by weight of a modified, aminofunctional organopolysiloxane antifoam agent, comprising at least one siloxane unit of the formula $$R^1_a Q_b SiO_{\frac{4-(a+b)}{2}} \quad \text{(I)}$$

and siloxane units of the formula $$R^1_cSiO_{\frac{4-c}{2}} \quad \text{(II)}$$

where $R^1$ each is identical or different and is a hydrogen atom, a monovalent, optionally fluorine-, chlorine- or bromine-atom-substituted $C_1$- to $C_{18}$-hydrocarbon radical or a $C_1$- to $C_{12}$-alkoxy radical or a hydroxy radical, Q each is identical or different and is a modified or unmodified amino radical of the formula $$—R^2—[NR^3—(CH_2)_m—]_xNR^4R^5 \quad \text{(III)}$$

or forms thereof partially or completely protonated on the nitrogen atoms, where $R^2$ is a divalent $C_1$-$C_{18}$-hydrocarbon radical, $R^3$ is a hydrogen atom, a $C_1$-$C_{10}$-alkyl radical or a radical G of the formula $$—C(=O)—O—R^6 \quad \text{(IV)},$$

$R^4$ is a hydrogen atom, a $C_1$-$C_{10}$-alkyl radical or a radical G of the formula (IV), $R^5$ is a hydrogen atom, a $C_1$-$C_{10}$-alkyl radical or a radical G of the formula (IV), $R^6$ is a monovalent hydrocarbon radical having 1 to 18 carbon atoms which is unsubstituted or is substituted with one or two hydroxy groups, with the proviso that at least one radical Q has at least one radical G of the formula (IV), a is 0, 1 or 2, b is 1, 2 or 3, c is 0, 1, 2 or 3, m is 2, 3 or 4 and x is 0, 1 or 2, and the sum a+b is less than or equal to 3, and (a) 65 to 95% by weight of a carrier material selected from the group consisting of sodium carbonate, sodium sulfate, aluminium silicate, potassium carbonate, potassium sulfate, sodium hydrogen carbonate, potassium hydrogen carbonate, zeolites, porous copolymers of urea or melamine or mixtures thereof with an alkanal, and mixtures thereof.

2. The antifoam powder claim 1, wherein at least one modified, aminofunctional organopolysiloxane (a) is one of the formula $$Q_kR^1_{3-k}SiO(R_2SiO)_p(QR^1SiO)_nSiR^1_{3-k}Q_k \quad \text{(V)},$$

where

R is identical or different and is a monovalent $C_1$- to $C_{18}$-hydrocarbon radical, k is 0 or 1, p is 0 or an integer from 1 to 1000, n is 0 or an integer from 1 to 50, with the proviso that the organopolysiloxane of the formula (V) contains at least one radical Q, which has at least one radical G of the formula (IV) according to claim 1, per molecule.

3. The antifoam powder of claim 1, wherein G is a radical of the formula $$—C(=O)—O—CH_2CH(CH_3)OH \quad \text{(VI)}.$$

4. The antifoam powder of claim 2, wherein G is a radical of the formula $$—C(=O)—O—CH_2CH(CH_3)OH \quad \text{(VI)}.$$

5. The antifoam powder of claim 1, wherein at least one radical Q is a radical of the formula $NH_2CH_2CH_2NH(CH_2)_3$— or its partially or completely protonated forms $N^+H_3CH_2CH_2NH(CH_2)_3$—$Z^-$ or $N^+H_3CH_2CH_2N^+H_2(CH_2)_3$— 2 $Z^-$ or modified amino radicals (G-)$NHCH_2CH_2NH(CH_2)_3$—, $NH_2CH_2CH_2$(G-)$N(CH_2)_3$—, (G-)$NHCH_2CH_2$(G-)$N(CH_2)_3$—, (G-)$_2NCH_2CH_2NH(CH_2)_3$— or (G-)$_2NCH_2CH_2$(G-)$N(CH_2)_3$—, where the modified radicals can be partially or completely protonated on the nitrogen atoms, with the proviso that at least one modified amino radical is present in the organopolysiloxane (a), where G is a radical of the formula (IV)

$Z^-$ is an anion to $N^+$.

6. The antifoam powder of claim 1, wherein at least one radical Q is a radical of the formula $NH_2CH_2CH_2NH(CH_2)_3$— or its partially or completely protonated forms $N^+H_3CH_2CH_2NH(CH_2)_3$— $Z^-$ or $N^+H_3CH_2CH_2N^+H_2(CH_2)_3$— 2 $Z^-$ or modified amino radicals (G-)$NHCH_2CH_2NH(CH_2)_3$—, $NH_2CH_2CH_2$(G-)$N(CH_2)_3$—, (G-)$NHCH_2CH_2$(G-)$N(CH_2)_3$—, (G-)$_2NCH_2CH_2NH(CH_2)_3$— or (G-)$_2NCH_2CH_2$(G-)$N(CH_2)_3$—, where the modified radicals can be partially or completely protonated on the nitrogen atoms, with the proviso that at least one modified amino radical is present in the organopolysiloxane (a), where G is a radical of the formula —C(=O)—O—$CH_2CH(CH_3)OH$, $Z^-$ is an anion to $N^+$.

7. The antifoam powder of claim 5, wherein $Z^-$ is an anion of a carboxylic acid.

8. The antifoam powder of claim 1, wherein $R^1$ is a $C_1$- to $C_{18}$-hydrocarbon radical or a $C_1$- to $C_3$-alkoxy radical or a hydroxy radical.

9. A process for producing an antifoam powder of claim 1, comprising mixing the modified, aminofunctional organopolysiloxane (a) with the carrier material (b).

10. In a detergent composition comprising customary detergent components and an antifoam, the improvement comprising including as at least one antifoam, an antifoam powder of claim 1.

* * * * *